United States Patent [19]

Kälin

[11] Patent Number: 4,934,016

[45] Date of Patent: Jun. 19, 1990

[54] DEVICE FOR CONTINUOUSLY CLEANING A RUNNING WEB OF MATERIAL

[76] Inventor: Erich Kälin, Wilenstr. 55, Wilen-Wollerau, Switzerland

[21] Appl. No.: 261,355

[22] Filed: Oct. 21, 1988

[30] Foreign Application Priority Data

Sep. 21, 1988 [CH] Switzerland ..... 3515/88

[51] Int. Cl.[5] ..... A47L 5/38

[52] U.S. Cl. ..... 15/306 A; 15/308

[58] Field of Search ..... 15/306 A, 306 R, 308, 15/303

[56] References Cited

U.S. PATENT DOCUMENTS

| | | | |
|---|---|---|---|
| 2,245,109 | 6/1941 | Lapeyrouse | 15/306 A X |
| 2,515,223 | 7/1950 | Hollick | 15/306 A X |
| 3,654,659 | 4/1972 | Blumenthal | 15/306 A |
| 3,775,806 | 12/1973 | Olbrant et al. | 15/306 A |

FOREIGN PATENT DOCUMENTS

| | | | |
|---|---|---|---|
| 201161 | 1/1966 | Sweden | 15/306 A |

*Primary Examiner*—Chris K. Moore

*Attorney, Agent, or Firm*—Herbert Dubno

[57] ABSTRACT

In the device for continuously cleaning a running web of material, the web is continuously moved past an air suction space which extend across the entire width of the web and is in flow connection with an air suction power unit via an air suction channel. The air suction space, which is in flow connection with the air suction channel, can be converging guides, of which a plurality are arranged in tandem in the direction of movement of the web. A plurality of them are also arranged side by side, and these open out into a mutual plane parallel to the web of material. For creating a spread-out holding effect, a plurality of rods, serving as support of the web of material and obliquely towards the middle of the web, and extend in the opening plane of the converging air guides.

10 Claims, 2 Drawing Sheets

DEVICE FOR CONTINUOUSLY CLEANING A RUNNING WEB OF MATERIAL

FIELD OF THE INVENTION

The present invention relates to a device for continuously cleaning a running web of material, in particular paper or fabric, wherein the web of material is continuously moveable past air suction means, said suction means extending across the entire width of the web of material and being in flow connection with an air suction channel.

BACKGROUND OF THE INVENTION

It is generally known that wed-shaped semimanufactured products, such as of paper, of synthetic materials, of woven fabrics or also of precious metals are to be freed of dust, dirt and lint prior to subsequent treatment thereof, for example, in order to prevent misprinting in the printing factory, fouling of processing baths in the finishing shops and so forth.

Prior art dust-collecting devices, in particular with air jets, are not, however, in a position to meet the increasing demands on the degree of dust collecting. If, for example, a web of textile fabric is fed at 60 m/mm over a suction slit having a width of 20 mm, then the effective time of the air current amounts to approximately 0.02 sec. This is seldom suffucient for an effective cleaning and is absolutely useless for flocked webs of material.

It is, therefore, a primary object of this invention to provide a device of the aforementioned kind which, despite the high feed velocity of the web, ensures a long effective time of the air current and thus an optimum cleaning.

SUMMARY OF THE INVENTION

This object is achieved according to the invention, by providing the air suction means, which are in flow connection with the air suction channel, as converging air guides, of which a plurality are arranged in tandem in the direction of movement of the web, as well as a plurality thereof being arranged side by side, so that these converging air guides open out into a common plane parallel to the web of material. For creating a spread-out holding effect, a plurality of rods or slats, serving as support for the wed of material, are arranged in a lattice array in the direction of the web of material and obliquely towards the middle of the web in the opening plane of the converging an guides. For creating a large-area suction opening plane, three converging air guides are arranged symmetrically in tandem to one another, and open out funnel-shaped into the opening plane, the two outer converging air guides, a deflection of approximately 90°.

As a result of these steps, a device for continuously cleaning a running web of material, having high cleaning capability with simultaneous spread-out holding of the wed of material is achieved without additional means.

In this connection, it is advantageous that the latticed rods are supported, as to be, adjustable in regard to the obliquity thereof, on a frame, and that two guide bars for the guidance of the web of material project from the frame outside the rods, extending across the entire width of the device and projecting above the supporting plane of the rods for the web of material.

Depending on application, the rods are constructed on the support-side of the web, as scrapers or brushes.

BRIEF DESCRIPTION OF THE DRAWING

The invention will be better understood and objects other than those set forth above, will become apparent when consideration is given to the following detailed description thereof. Such description makes reference to the annexed drawing wherein.

SPECIFIC DESCRIPTION

Figure 1:
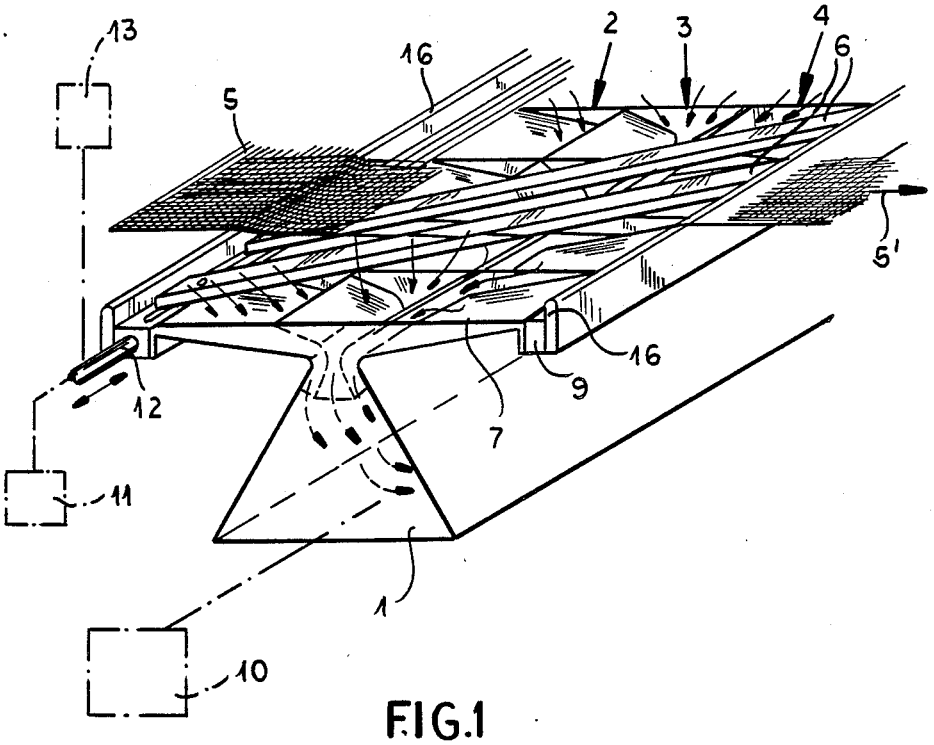
FIG. 1 is a diagrammatic partial perspective view of the device for continuously cleaning a web of material according to the invnetion.
Figure 2:
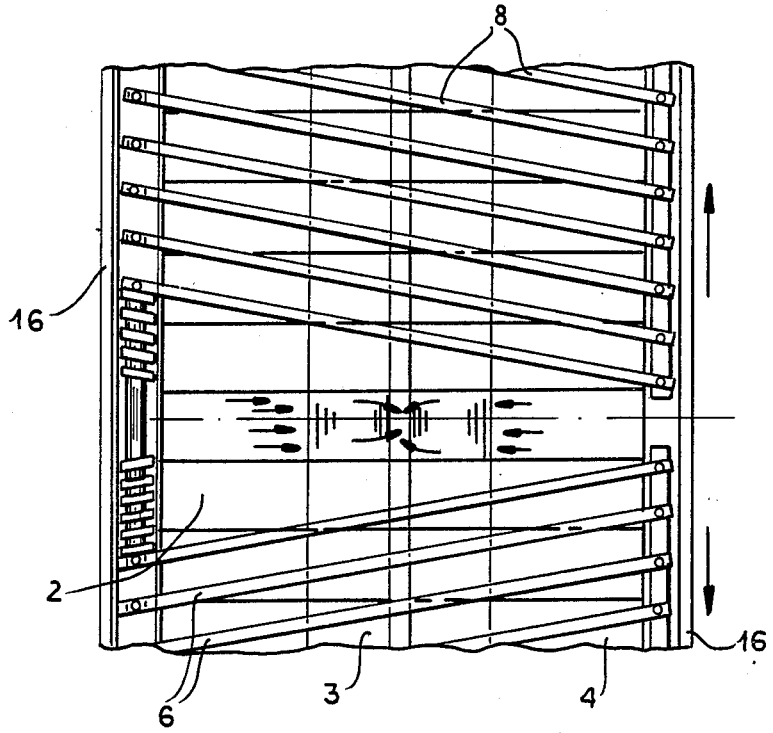
FIG. 2 is a detailed plan view of the arrangement according to FIG. 1.

In the represented device for continuously cleaning a running web of material, in particular paper or fabric, the web of material is continuously moved past, in the instant case horizontally, an air suction means 2,3,4 in per se known manner, extending acroos the entire width of the web of material and being in flow connection with an air suction power unit 10 (high-pressure ventilator) via an air suction channel 1.

In accordance with this invention the air suction means are converging air guides 2,3 and 4 with wide sides open toward the web, of which a plurality are arranged in tandem in the direction of movement 5' of the web 5, as well as a plurality thereof being arranged side by side, wherewith these open out into a common plane 7 parallel to the web of material.

Figure 3:
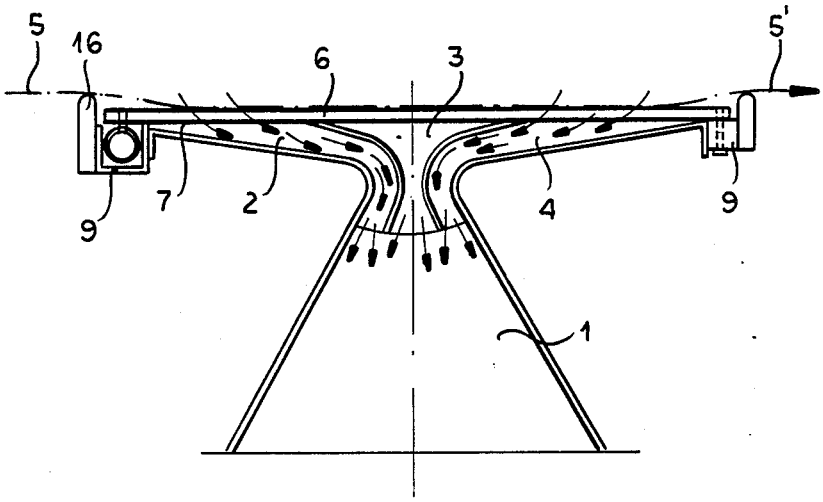
FIG. 3 is a vertical cross section of the arrangement according to FIG. 1.

It is here of advantage that, in each case, three converging air guides 2,3 and 4 are arranged symmetrically in tamdem to one another, and open out funnel-shaped into the opening plane 7, the two outer air guides 2 and 4 having, thereby, a deflection of approximately 90°, as is shown in particular in FIG. 3.

In this way, the web of material 5 is subjected to suction over a large area, which brings about an optimum cleaning effect.

Furthermore, it is essential to the invention that a plurality of rods or slats 6 and 8, serving as support for the web of material 5, are arranged in a lattice array in the direction of the web of material and obliquely towards the middle of said web; these slats extend in the opening plane 7 of the converging air guides 2,3,4.

These steps secure a spread-out holding effect on the web material, without having to take further measures therefor.

Advantageous by, the latticed rods 6,8 are supported so as to be adjustable in regard to the obliquity thereof, on a frame 9.

Adjustment can, thereby, take place manually or by means of a hydraulic valve 11 or by means of motor-driven spindle means (not shown). The valve 11 can control a spindle 12 common to slats 6,8.

Moreover, vibrator means 13 may engage the adjusting shaft or spindle 12 common to the rods, which further increases the cleaning effect.

Further, it is of advantage that two guide bars 16 for the guidance of the web of material 5 project from said frame 9 upstream and down said rods 6,8, extending across the entire width of the device and projecting above the supporting plane of said rods 6,8 for the web of material 5.

Depending on the application of the device according to the invention, it is of advantage if the rods 6,8 are constructed, support-side of the web, as scrapers or brushes.

Thus, from the foregoing, there results a device for continuously cleaning a running web of material, which is suitable to meet all today's demands with regard to quality and effectiveness.

While there are shown and described preferred embodiments of the invention, it is to be distinctly understood that the invention is not limited thereto but may be embodied and practiced within the scope of the following claims.

Accordingly, what I claim is:

1. A device for continuously cleaning a running web, comprising:

air suction means including a plurality of converging air guides arrayed transversely across a full width of said web and arrayed in a direction of longitudinal travel of said web, said air guides opening at upstream sides in a common plane across which said web is guided and converging away from said plane;

means for connecting downstream sides of said guides to a suction source; and a plurality of spaced apart slats arranged in a lattice array in said plane and inclined obliquely to said direction toward a middle of said web.

2. The device defined in claim 1 wherein three of said guides are arranged symmetrically in tandem to one another in said direction and include a pair of outer guides and an intermediate guide, all of said guides being funnel-shaped and opening at said plane, said outer guides having configurations providing an air deflection of approximately 90° for air flow from said plane to said downstream sides thereof.

3. The device defined in claim 2, further comprising means supporting said slats in said plane, and means for adjusting the inclination of said slats to said direction on said frame.

4. The device defined in claim 3, further comprising a pair of support bars disposed respectively upstream and downstream of said lattice array of said slats across the width of said web and projecting above said lattice array for guiding said web over said lattice array.

5. The device defined in claim 3 wherein said slats are formed on sides thereof supporting said web as scrapers.

6. The device defined in claim 3 wherein said slats are formed on sides thereof supporting said web as brushes.

7. The device defined in claim 1, further comprising means supporting said slats in said plane, and means for adjusting the inclination of said slats to said direction on said frame.

8. The device defined in claim 7, further comprising a pair of support bars disposed respectively upstream and downstream of said lattice array of said slats across the width of said web and projecting above said lattice array for guiding said web over said lattice array.

9. The device defined in claim 7 wherein said slats are formed on sides thereof supporting said web as scrapers.

10. The device defined in claim 7 wherein said slats are formed on sides thereof supporting said web as brushes.

* * * * *